United States Patent [19]

Honegger

[11] Patent Number: 4,705,227

[45] Date of Patent: Nov. 10, 1987

[54] APPARATUS FOR WINDING-UP AND UNWINDING CONTINUOUSLY ARRIVING FLEXIBLE FLAT STRUCTURES

[75] Inventor: Werner Honegger, Tann Rüti, Switzerland

[73] Assignee: Ferag AG, Hinwil, Switzerland

[21] Appl. No.: 34,622

[22] Filed: Apr. 6, 1987

[30] Foreign Application Priority Data

Apr. 14, 1986 [CH] Switzerland ..... 1475/86

[51] Int. Cl.[4] ..... B65H 75/00; B65H 18/02; B65H 18/04

[52] U.S. Cl. ..... 242/59; 242/67.1 R; 242/68.3

[58] Field of Search ..... 242/59, 67.1 R, 57.1, 242/55, 58.6, 68.3

[56] References Cited

U.S. PATENT DOCUMENTS

| | | | |
|---|---|---|---|
| 3,066,388 | 12/1962 | Cooper | 242/59 X |
| 4,593,865 | 6/1986 | Honegger | 242/67.1 R |
| 4,601,436 | 7/1986 | Honegger | 242/59 |
| 4,657,196 | 4/1987 | Irish | 242/55 |
| 4,659,030 | 4/1987 | Graves et al. | 242/58.6 |

*Primary Examiner*—Stuart S. Levy
*Assistant Examiner*—Thomas R. Hannon

[57] ABSTRACT

A substantially ring-shaped or annular winding core serving for the reception of a package of products wound thereupon is frictionally mountable at its substantially cylindrical inner surface upon drivable support wheels and can be again lifted-off such drivable support wheels. At the inner surface of the mounted winding core there can be placed into operative position beneath the support wheels an essentially freely rotatable guide wheel. This freely rotatable guide wheel prevents lift-off of the winding core from the support wheels and can increase the friction which prevails therebetween. In order to be able to use winding cores having a purely cylindrical smooth inner surface and during the rotation thereof to nonetheless ensure for an exact positioning in axial direction, the guide wheel is deflectable in its operative position about a deflection axis which is radially directed with respect to the mounted winding core, which imparts to the rotating winding core an axial movement component, and an impact or stop arrangement is provided for limiting such axial movement.

13 Claims, 5 Drawing Figures

APPARATUS FOR WINDING-UP AND UNWINDING CONTINUOUSLY ARRIVING FLEXIBLE FLAT STRUCTURES

CROSS-REFERENCE TO RELATED APPLICATION

This application is related to the commonly assigned, copending U.S. application Ser. No. 07/005,693, filed Jan. 22, 1987, and entitled "APPARATUS FOR WINDING A CONTINUOUSLY ARRIVING IMBRICATED FORMATION OF FLEXIBLE FLAT STRUCTURES INTO A WOUND PRODUCT PACKAGE".

BACKGROUND OF THE INVENTION

The present invention broadly relates to a new and improved construction of an apparatus for selectively winding-up or unwinding continuously arriving flexible flat structures, especially substantially flat products arriving in an imbricated formation, particularly substantially flat printed products.

In its more particular aspects, the present invention relates to a new and improved construction of an apparatus for winding-up and unwinding or winding-off continuously arriving flexible flat structures, especially flexible flat structures arriving in an imbricated formation, and in particular printed products into a wound product package or unwinding such flexible flat structures from a previously wound product package. The winding apparatus of the present development is of the type comprising a substantially ring-shaped or annular winding core intended for taking-up or receiving thereon the products wound into a product package. The substantially ring-shaped winding core can be frictionally placed into contact at its substantially cylindrical inner surface with drivable support wheels and can be raised away from such drivable support wheels. Furthermore, there is provided an essentially freely rotatable guide wheel which can be operatively engaged with the substantially cylindrical inner surface of the mounted winding core beneath the support wheels and can again be raised away from such substantially cylindrical inner surface of the mounted winding core.

At this point it is noted that in the context of this disclosure the term "winding apparatus" or equivalent expressions are to be construed in their broader sense as not only encompassing an apparatus for winding-up substantially flat structures or the like but also for unwinding or winding-off such substantially flat structures or the like which previously have been wound-up into a package.

Such type of winding apparatus is disclosed in the European Published Patent Application No. 0,061,569, published on Nov. 21, 1985 and the substantially corresponding U.S. Pat. No. 4,601,436, granted July 22, 1986, and entitled "APPARATUS FOR WINDING AND UNWINDING FLEXIBLE FLAT PRODUCTS, ESPECIALLY PRINTED PRODUCTS, ARRIVING CONTINUOUSLY, ESPECIALLY IN IMBRICATED FORMATION".

With this heretofore known apparatus the substantially ring-shaped winding core in the event that it is driven, constitutes the driven part of a friction wheel drive and the support wheels serving as the mounting structure, upon which bears the winding core at its inner surface or side, simultaneously constitute the driving part of the friction wheel drive.

So that the winding core during its rotation does not migrate or drift in axial direction, or also is not able to alter its axial position—something which can lead to the formation of a conical package—, the winding core of the prior art apparatus possesses inwardly protruding side flanges which coact to a certain extent as guide or track rims with the end surfaces of the support wheels, but also in conjunction with the guide wheel.

This is associated with a number of different drawbacks. Firstly, the winding core and particularly the spacing of its side flanges from one another must be accommodated to the thickness of the support wheels and the guide wheel, which, in turn, cannot be constructed as rolls. The thickness of the support wheels and that of the guide wheel must correspond to one another, and furthermore, the end surfaces of all wheels must lie in a respective plane if the side flanges of the winding core are to fulfill their function as guide or track rims.

Additionally, with the heretofore known apparatus, in the event it is desired to lift-off the winding core from the support wheels, the winding core initially must be vertically raised at least by the amount of the radial dimension of the side flanges before the winding core can then be removed in axial direction. This vertical lifting of the winding core, particularly in the case of a winding core upon which there has been fully wound a product package, requires an appreciable expenditure of force.

Finally, with the prior art apparatus there always must be reached a compromise as concerns the dimensioning of the winding core. On the one hand, as previously mentioned, the side flanges of the winding core must be accommodated to the thickness of the wheels, and, on the other hand, the outer surface of the winding core should be accommodated to a certain degree to the format of the flat surface structures or products which are to be wound upon such winding core so that such wound products are supported as much as possible over the major part of their width directly or indirectly upon the outer jacket surface of the winding core.

SUMMARY OF THE INVENTION

Therefore, with the foregoing in mind it is a primary object of the present invention to provide a new and improved construction of a winding apparatus of the previously mentioned type which is not afflicted with the aforementioned drawbacks and shortcomings of the prior art.

Another and more specific object of the present invention aims at the provision of a new and improved construction of a winding apparatus for the winding-up or unwinding of substantially flat structures, especially although not exclusively printed products, wherein the winding core can possess a purely hollow cylindrical configuration, in other words approximately the shape of a flangeless tubular section or tube, which facilitates the removal of the winding core and its improved accommodation thereof to the width of the flat structures or products being processed.

In keeping with the aforementioned object it is still a further noteworthy object of the present invention to provide an improved winding apparatus of the character described wherein the support wheels and the guide wheel—apart from their coaction with the inner surface of the winding core—can be dimensioned independently of the construction of the winding core, and there is nonetheless still ensured for a relatively constant axial position of the winding core during its rotational movement.

Now in order to implement these and still further objects of the invention, which will become more readily apparent as the description proceeds, the winding apparatus, as such term is herein defined, of the present development is manifested by the features that the guide wheel can be deflected or shifted about a deflection axis which is radially directed with respect to the mounted winding core, and additionally, there is provided an impact or stop arrangement which coacts with an end side or surface of the winding core.

Now if there is imparted to the guide wheel a deflection or steering deflection, in other words when its rotational axis no longer is disposed exactly parallel to the rotational axis of the support wheels, the winding core during its rotation additionally has imparted thereto an axial movement component which, depending upon the direction of rotation of the winding core and depending upon the side of the deflection, forces the winding core to migrate or drift either towards the impact or stop arrangement, whereby its axial position is fixed, or, however, causes the winding core to migrate or wander away from the impact or stop arrangement which, in turn, appreciably simplifies the removal of the winding core. For the deflection of the guide wheel there is sufficient only a few angular degrees motion.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
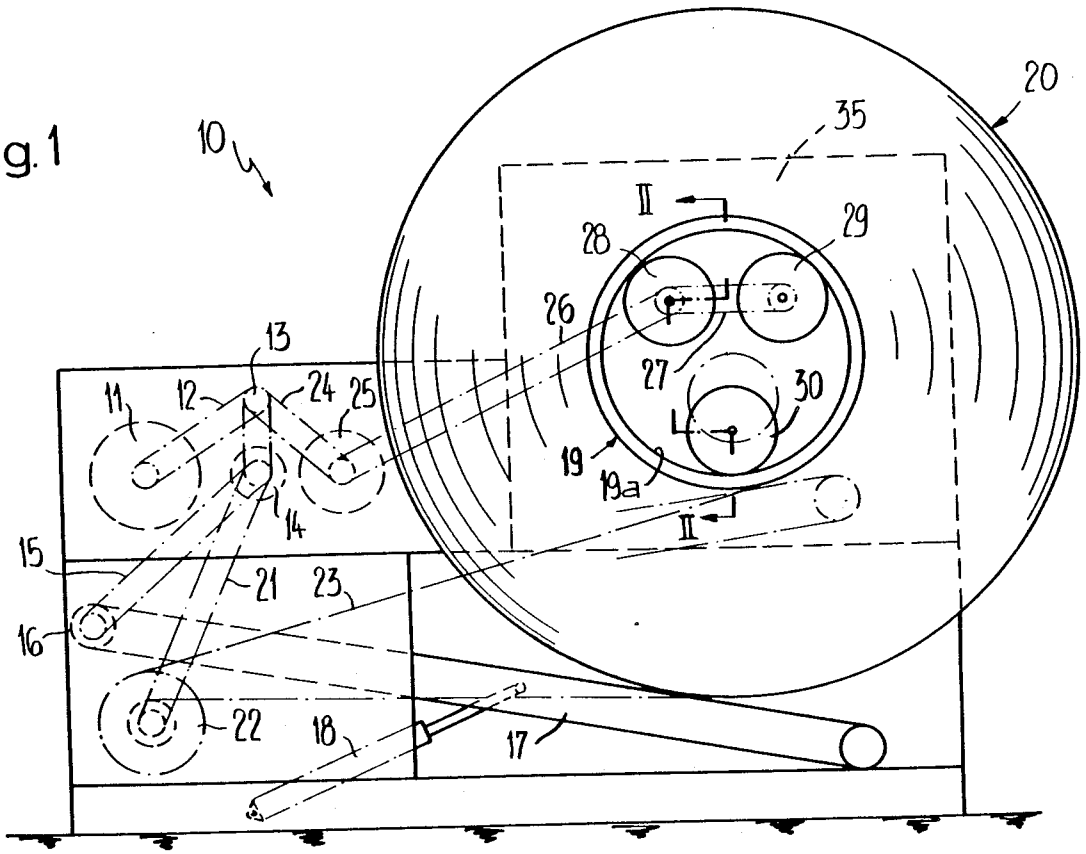
FIG. 1 is an extremely schematic side view of a winding apparatus constructed according to the present invention.

Describing now the drawings, it is to be understood that only enough of the structure of the winding apparatus for the winding-up or unwinding of continuously arriving, flexible flat structures, particularly flexible flat structures arriving in an imbricated formation, in particular, although not exclusively, printed products, has been shown in the drawings as needed for one skilled in the art to readily understand the underlying principles and concepts of the present development while simplifying the illustration. At this juncture reference will be made to FIG. 1 for explaining certain details of the winding apparatus of the present development. In the case of the apparatus 10 depicted by way of example and not limitation in FIG. 1, it will be recognized that a drive motor 11 drives by means of a chain 12, an intermediate gearing or reduction gearing structure 13, the gearing 14 as well as by means of a further chain 15 a deflection roll or roller 16 of a band or belt conveyor 17. This band or belt conveyor 17 is supported by a not particularly illustrated but conventional rocker-like or balance frame which is pivotable about the rotational axis of the deflection roll or roller 16 and can be continuously forced by means of a gas spring 18 or equivalent structure against the outer circumference of a winding core 19 or a package 20 which is in the process of being formed thereon, as the case may be.

The band or belt conveyor 17, formed for instance of a number of small or narrow adjacently arranged small belts or bands as is known in this art, delivers to the package 20 the not particularly illustrated flexible flat structures or products and, as the case may be, that is in the package unwinding mode also can convey such previously wound flat structures away during the winding-off or unwinding of the prior wound product package 20. By means of a further chain 21 which leads from the gearing or gear means 14 there is driven a supply roll or roller 22 for a winding band or tape 23—also sometimes referred to in the art as a partition or separation band or tape—which, in turn, extends through a pair of neighboring small belts or bands of the band or belt conveyor 17 to the region of the winding core 19 or, as the case may be, to the region of contact of the band or belt conveyor 17 at the package 20. During the course of the winding operation this winding band or tape 17 is wound-up in conjunction with the flat structures or products (not shown) which are supplied by the band or belt conveyor 17 or, as the case may be, during the unwinding of the prior wound package 20 this winding band or tape 23 is again wound or coiled up onto the supply roll 22.

Leading from the intermediate gearing or reduction gearing structure 13 is a further chain or chain member 24 to a winding gearing or transmission 25 possessing an automatically infinitely variable transmission ratio. From the winding gearing or transmission 25 there leads a further chain or chain member 26 to two support wheels 28 and 29 which are operatively interconnected with one another for rotation in the same rotational sense by means of a further chain or chain member 27. The winding core 19 is mounted or supported upon the support wheels 28 and 29 and these support wheels 28 and 29, during such time as they are driven, frictionally drive the winding core 19 in the same rotational direction or sense.

The mounting of the winding core 19 is augmented by an essentially freely rotatable guide wheel 30 which is elevationally displaceable, in other words can be selectively raised and lowered and in its lowered position likewise coacts with the substantially cylindrical inner surface or side **19*a* of the winding core 19 and not only precludes any undesired lift-off of the winding core 19 from one of the support wheels 28 and 29, but additionally also can increase the friction between these support wheels 28 and 29 and the substantially cylindrical inner surface 19*a* of the winding core 19. By means of the support wheels 28 and 29 and the guide wheel 30** there is thus ensured in all instances a central position of the winding core 19.

Figure 2:
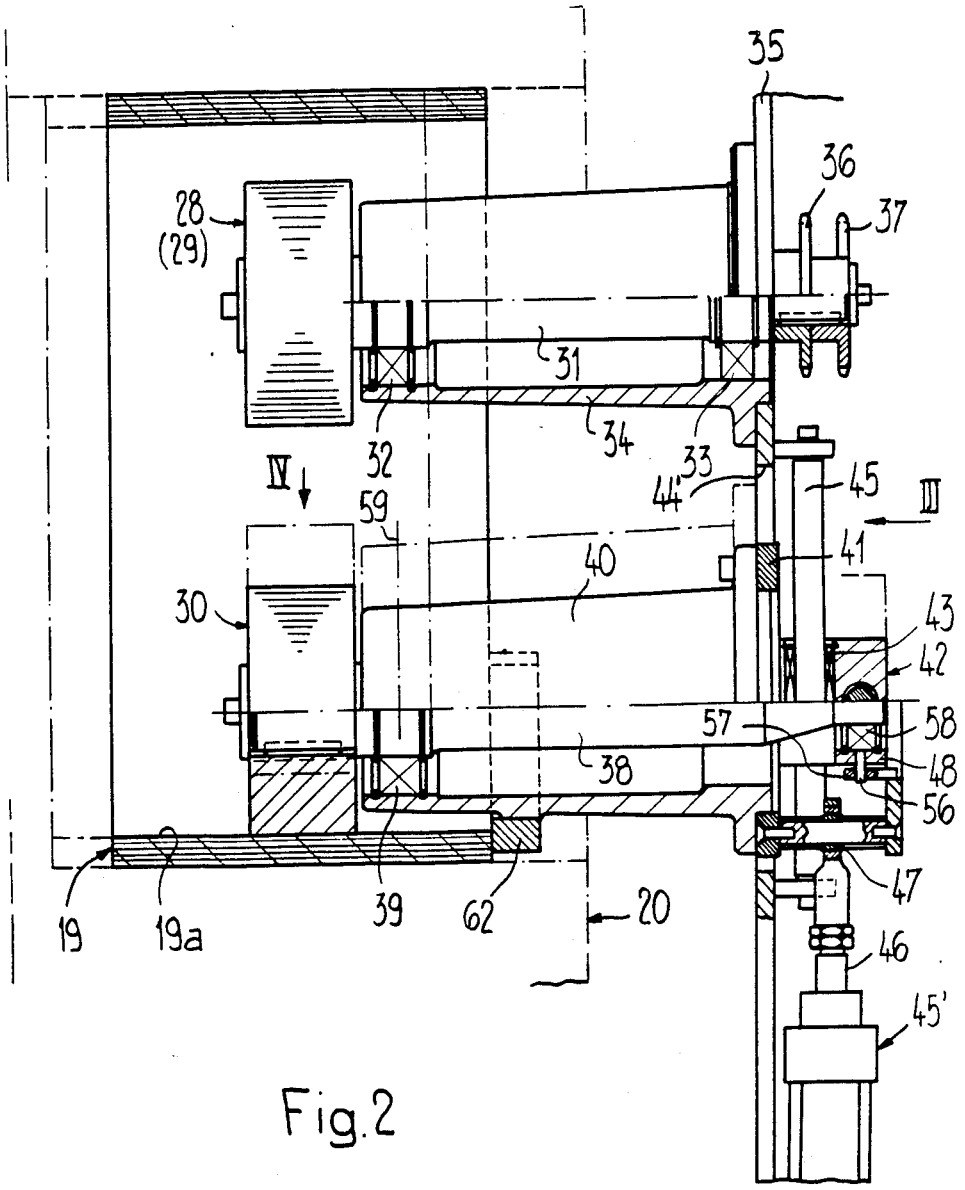
FIG. 2 is a cross-sectional view on an enlarged scale of a detail of the winding apparatus depicted in FIG. 1, taken substantially along the line II—II thereof.
Figure 3:
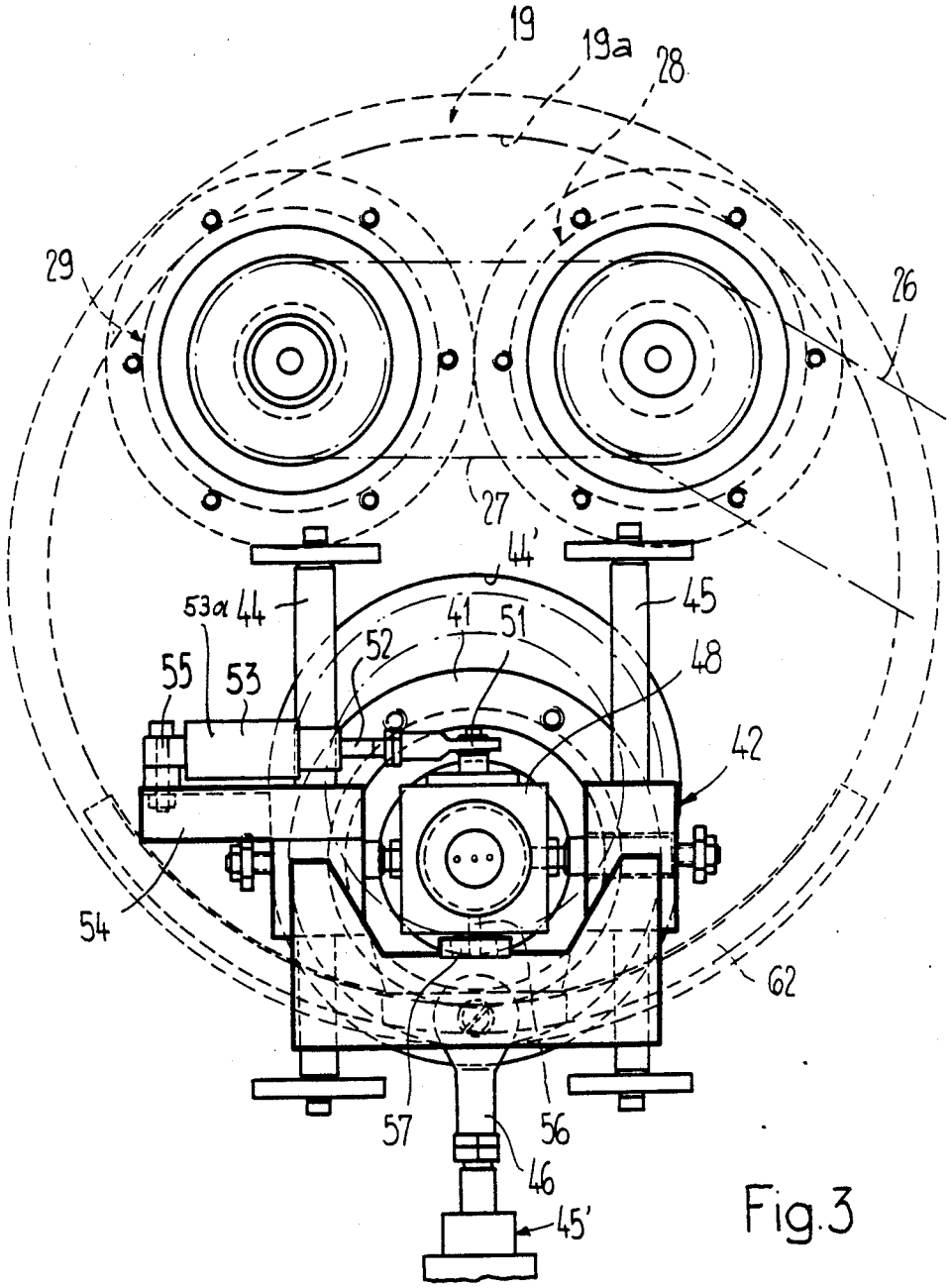
FIG. 3 is a view looking in the direction of the arrow III of FIG. 2, still on a somewhat larger scale, of a portion of the winding apparatus depicted therein, and wherein there has been indicated in broken lines the elements arranged behind the side wall.
Figure 4:
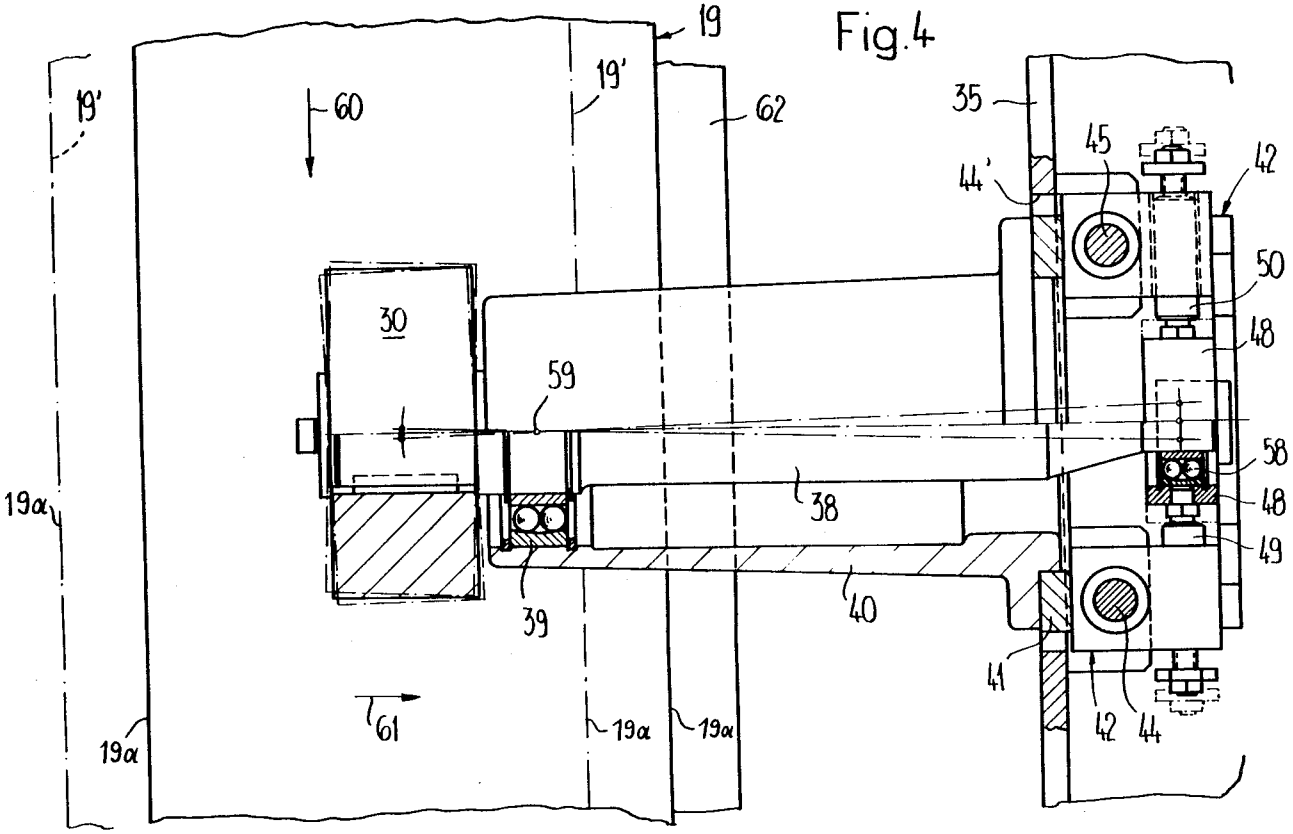
FIG. 4 shows on a still somewhat larger scale a top plan view, partially in section, looking in the direction of the arrow IV of FIG. 2 of the guide wheel.

Reference will now be made to FIGS. 2, 3 and 4. There will be recognized from the showing of FIG. 2 the one support wheel 28 as well as the guide wheel 30. This guide wheel 30 has been depicted in full lines in its operative or engaged position with the substantially cylindrical smooth inner surface 19*a* of the winding core 19. A portion of the outline of the wound package 20 has been shown in chain-dot lines. The support wheel 28 is keyed or otherwise appropriately connected with a shaft 31 which, in turn, is rotatably mounted by means of two roller bearings 32 and 33 in a bearing housing 34. This bearing housing 34 is fixedly flanged or otherwise appropriately connected at the one side of a substantially vertical side wall or wall member 35 of the machine frame. The end of the shaft 31 which is remote from the support wheel 28 piercingly extends through this side wall or wall member 35 and has keyed thereto or otherwise appropriately fixed thereat the sprocket wheels 36 and 37 which coact with the respective chains 26 and 27. The mounting and arrangement of the other support wheel 29 corresponds to that of the support wheel 28 just described.

The guide wheel 30 is likewise keyed or otherwise appropriately fixed to a shaft 38. This shaft 38 is rotatably mounted by means of a pendulum roller bearing 39 in a bearing housing 40. This bearing housing 40 is flanged or otherwise appropriately connected to a substantially ring-shaped plate or plate member 41 which, in turn, is anchored to a carriage 42, as best seen by referring to FIGS. 3 and 4. This carriage or carriage member 42, which has been accentuated in FIG. 3 by a thick border line, is displaceably guided by means of ball bushings or boxes 43 (FIG. 2) upon two substantially parallel column members or columns 44 and 45, so that the deflection or guide axis of the bearing housing 40 is radially displaceable with respect to the winding core 19, and specifically in a recess or opening 44' which is present in the side wall or wall member 35. For elevationally displacing, that is for raising and lowering the bearing housing 40 there is provided a displacement means comprising a fluid-operated piston-and-cylinder unit or fluid-operated unit 45', the piston rod 46 of which is hingedly connected by means of a universal joint 47 or the like (FIG. 2) at the center of the carriage 42.

From the illustration of FIG. 3 it will be apparent that the carriage 42 possesses an essentially U-shaped configuration. This carriage 42 engages about a bearing plate 48 or block which is retained by yieldable pins or pin members 49 and 50 (FIG. 4) located at oppositely situated sides of the bearing plate 48, so that the bearing plate 48 is retained between the legs of the carriage 42 in such a manner that the bearing plate 48 cannot move in relation to the carriage 42 in a direction parallel to the column members 44 and 45, rather only substantially perpendicular thereto. For this purpose the piston rod 52 of a further fluid-operated piston-and-cylinder unit 53 is hingedly connected at location 51 with the bearing plate 48, and whose cylinder 53*a* is hingedly connected at location 55 at the end of a cantilever or cantilever member 54 which laterally protrudes from the carriage 42. In order to secure the bearing plate 48 also against any tilting or canting motion a pin or pin member 56 is anchored at its side located opposite to the hinge point 51. This pin member 56 engages into a guide element or piece 57 secured at the carriage 42.

In the bearing plate 48 there is mounted a further pendulum roller bearing 58 in which there is supported or mounted the end of the shaft 38 located remote from the guide wheel 30. Since the bearing plate 48 and thus also the pendulum roller bearing 58 can be displaced transverse to the direction of the columns 44 and 45, the shaft 38 can be pivoted throughout a limited angular range about the center or central plane of the pendulum roller bearing 39, or, stated in other words, this center corresponds to a deflection or guide or steering axis 59 about which there can be deflected the guide wheel 30. In FIG. 4 there has been shown in full lines the outline of the non-deflected guide wheel 30, whereas in chain-dotted lines there has been illustrated the outline of such guide wheel in both possible terminal or end positions of the deflection motion.

It is now assumed that the winding core 19 is mounted upon the support wheels 28 and 29 in such a manner that the ends or lateral sides 19*a* of the winding core 19 assume the position depicted in chain-dot lines 19' in FIG. 4. The winding core 19 is then placed into rotational movement by the support wheels 28 and 29 in such a manner that the substantially cylindrical inner surface or side 19*a* of the winding core 19, upon which acts the guide wheel 30, moves in the direction of the arrow 60. In the axial direction the winding core 19 is not yet now exactly positioned. It is sufficient to upwardly displace the bearing plate 48 in the showing of FIG. 4, so that the rotational axis, depicted in chain-dotted lines, of the guide wheel 30 is rocked or pivoted through a few degrees in the counterclockwise direction about the deflection or steering axis 59, so that the guide wheel 30 has imparted thereto a corresponding deflection. By virtue of this deflection the guide wheel 30 imparts to the winding core 19 a movement component in the direction of the arrow 61 of FIG. 4. The winding core 19 thus drifts or migrates during its rotational movement in the direction of the side wall or wall member 35, in other words into its proper axial position.

This proper axial position is determined or governed by an impact or stop arrangement, here shown in the form of a substantially arcuate-shaped impact or stop rail 62 which, as best seen by referring to FIG. 2, is secured to the bearing housing 40 of the shaft 38 and thus is elevationally displaceable therewith, in other words can move up and down in conjunction therewith, and the impact or stop rail 62 is arranged concentrically with respect to the mounted winding core 19. This impact or stop rail 62 is arranged as shown in FIG. 3 so as to have a vertical plane passing through the axis of rotation of the non-deflected guide wheel 30, and such impact or stop rail 62 can extend to both sides of such vertical plane through essentially equal length arcuate sections. In order to be able to utilize the winding apparatus also for winding cores possessing different axial lengths, the impact or stop rail 62 can also be arranged to be displaceable and positionally fixable in desired position along the bearing housing 40. On the other hand, there can be provided instead of the impact or stop rail 62 also freely rotatable impact or stop rolls or rollers, whose axes of rotation are directed radially with respect to the mounted winding core 19.

If the bearing plate or block 48, in the showing of FIG. 4, is downwardly shifted or displaced, in other words the axis of rotation of the guide wheel 30 pivoted or rocked in the clockwise direction about the deflection axis 59, then with constant direction of rotational movement of the winding core 19, as indicated by the arrow 60, there would occur a movement component opposite to the arrow 61 which, in turn, facilitates the removal or de-mounting of the winding core 19.

As soon as the winding core 19 has attained its proper or correct axial position then the deflection or steering deflection of the guide wheel 30 can be eliminated, so that the axis of rotation of the guide wheel 30 is disposed again exactly parallel to that of the support wheels 28 and 29. As a result there is no longer present the movement component represented by the arrow 61 and also any possibly prevailing frictional loss at the impact or stop rail 62.

Figure 5:
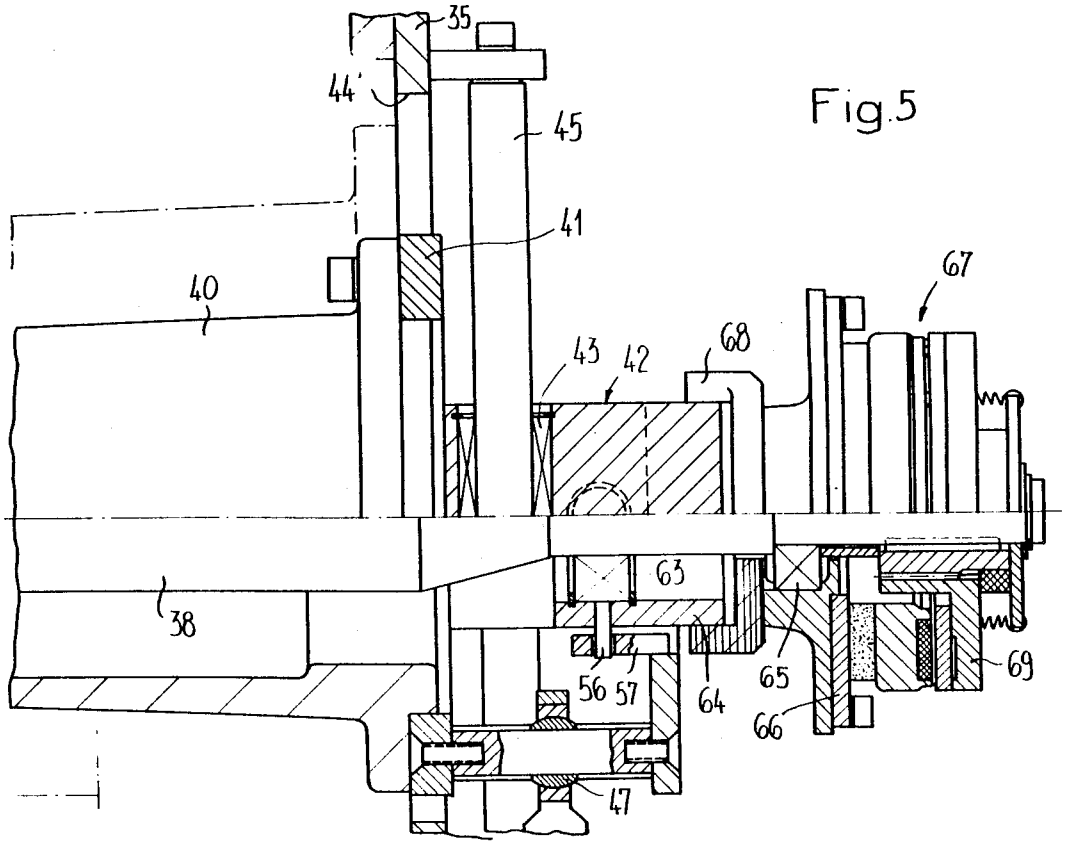
FIG. 5 illustrates a modified embodiment in a showing similar to the illustration of FIG. 2, but again on a somewhat larger scale.

While with the exemplary embodiment depicted in FIGS. 2 to 4 the guide wheel 30 together with the shaft or shaft member 38 is always freely rotatable and the deflection of the guide wheel 30 is obtained by appropriate pressure impingement of the fluid-operated piston-and-cylinder unit or actuation means 53, there can be utilized the fact that the deflection or steering axis 59 is located outside of the central plane of the guide wheel 30 for the purpose of causing the deflection to be accomplished also in a different manner. Such an embodiment is depicted in FIG. 5.

The end of the shaft 38 which piercingly extends through the side wall 35 is mounted in this case by means of a roller bearing 63 in a bearing sleeve or bearing block 64 which, like the bearing plate or block 48, can be displaced in relation to the carriage 42 transversely with respect to the columns or column members 44 and 45. The shaft 38 is prolonged past the roller bearing 63 and carries by means of a ball bearing 65 the one part 66 of an electromagnetic brake 67, which brake part 66 is secured against rotation by means of a guide bracket 68 which engages over the carriage or carriage member 42, without being hindered with respect to a transverse displacement. At the free end of the shaft 38, shown at the right-hand side of FIG. 5, there is keyed or otherwise appropriately attached the other part 69 of the brake 67.

As long as the electromagnetic brake 67 is not energized or rendered operative the shaft or shaft member 38 remains in a position substantially axially parallel to the rotational axes of the support wheels 28 and 29 due to the action of the pins or pin members 49 and 50 and there is not imparted to the winding core 19 any axial component of movement. If, however, the electromagnetic brakes 67 is energized or activated, then the braking of the guide wheel 30 brings about that this guide wheel 30 follows the direction of movement 60 of the rotating winding core 19 and thus initiates the deflection about the deflection axis 59. In this case there is however to be observed that the braking force is to be dimensioned such that the guide wheel 30 is not prevented in performing its rotational movement, rather is only somewhat hindered or retarded in performing such rotational movement. As soon as the electromagnetic brake 67 is again de-energized or inactivated the guide wheel 30 again assumes a position which is axially parallel to the support wheels 28 and 29.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for winding or unwinding continuously arriving, particularly imbricated flexible flat structures, preferably printed products, into a package or from such package, comprising:

a substantially ring-shaped winding core intended to support thereon the wound package;

said winding core having oppositely situated ends and a substantially cylindrical inner surface;

driven support wheels upon which there is frictionally mountable at the substantially cylindrical inner surface the winding core from which there can be de-mounted such winding core;

a substantially freely rotatable guide wheel arranged beneath said support wheels and capable of being brought into operative association with the substantially cylindrical inner surface of the mounted winding core and being raisable away from the substantially cylindrical inner surface of said mounted winding core;

means defining a deflection axis which is substantially radially directed with respect to the mounted winding core and cooperating with said guide wheel;

said guide wheel being deflectable about said substantially radially directed deflection axis in an operative position of said guide wheel; and impact means cooperating with one end of the oppositely situated ends of the winding core.

2. The apparatus as defined in claim 1, wherein:

said guide wheel has a central plane; and said deflection axis being arranged externally of said central plane of said guide wheel.

3. The apparatus as defined in claim 2, further including:

a shaft having an end;

said guide wheel being secured to said end of said shaft;

a bearing housing provided for said shaft and radially displaceable in a predeterminate direction of movement with respect to the mounted winding core;

said means defining said deflection axis including pendulum bearing means for mounting said shaft in said radially displaceable bearing housing;

said pendulum bearing means having a central plane; and said deflection axis being arranged at the region of the central plane of said pendulum bearing means.

4. The apparatus as defined in claim 3, wherein:

said shaft at which there is secured the guide wheel is prolonged at a side of the pendulum bearing means located opposite said guide wheel;

said shaft having a further end;

an adjustable bearing block displaceable with said bearing housing and additionally movable transversely to the direction of movement of the bearing housing; and a further bearing means for mounting said further end of the shaft in said adjustable bearing block.

5. The apparatus as defined in claim 3, further including:

a displaceable carriage which is guided in radial direction with respect to the mounted winding core;

said bearing housing being secured to said displaceable carriage; and displacement means hingedly connected with said displaceable carriage.

6. The apparatus as defined in claim 5, wherein:

said shaft at which there is secured the guide wheel is prolonged at a side of the pendulum bearing means located opposite said guide wheel;

said shaft having a further end;

an adjustable bearing block displaceable with said bearing housing and additionally movable transversely to the direction of movement of the bearing housing;

a further bearing means for mounting said further end of the shaft in said bearing block;

an actuation element hingedly connected with the displaceable carriage; and said adjustable bearing block being displaceably guided by means of said actuation element transversely with respect to the displacement direction of the displaceable carriage.

7. The apparatus as defined in claim 3, wherein:

said shaft at which there is secured the guide wheel is prolonged at the side of the pendulum roller bearing located opposite to the guide wheel;

said shaft having a further end;

actuatable brake means provided for the further end of said shaft; and the guide wheel placed into rotation by the substantially cylindrical inner surface of the mounted winding core automatically being caused to perform a deflection about the deflection axis as a function of actuation of the actuatable brake means.

8. The apparatus as defined in claim 3, wherein:

said impact means comprises an impact rail.

9. The apparatus as defined in claim 8, wherein:

said impact rail possesses a substantially arcuate-shaped configuration and is arranged substantially concentrically with respect to the mounted winding core.

10. The apparatus as defined in claim 9, wherein:

said guide wheel has an axis of rotation;

said impact rail has a vertical plane passing through the axis of rotation of the non-deflected guide wheel; and said impact rail extending to both sides of said vertical plane through essentially equal length arcuate sections.

11. The apparatus as defined in claim 10, wherein:

said impact rail is secured to the bearing housing of the shaft of the guide wheel.

12. The apparatus as defined in claim 1, wherein:

said impact means comprises at least three freely rotatable rolls possessing axes of rotation extending radially with respect to the mounted winding core; and said three freely rotatable rolls having travel surfaces which define a plane.

13. The apparatus as defined in claim 1, wherein:

said impact means is adjustable and positionally fixable in axial direction of the substantially ring-shaped winding core.

* * * * *